US006324947B2

(12) United States Patent
Jarvis

(10) Patent No.: US 6,324,947 B2
(45) **Date of Patent: *Dec. 4, 2001**

(54) LOCKING SWIVEL WRENCH

(76) Inventor: Jack D. Jarvis, 3204 Periwinkle, Memphis, TN (US) 38127

( * ) Notice: Subject to any disclaimer, the term of this patent is extended or adjusted under 35 U.S.C. 154(b) by 0 days.

This patent is subject to a terminal disclaimer.

(21) Appl. No.: 09/727,350

(22) Filed: Dec. 1, 2000

Related U.S. Application Data

(63) Continuation of application No. 09/024,375, filed on Feb. 17, 1998, now Pat. No. 6,167,787, which is a continuation of application No. 08/878,231, filed on Jun. 18, 1997, now Pat. No. 5,943,924, which is a continuation of application No. 08/398,691, filed on Mar. 6, 1995, now abandoned.

(51) Int. Cl.[7] ..... B25B 23/16
(52) U.S. Cl. ..... 81/177.2; 81/177.8
(58) Field of Search ..... 81/177.2, 177.7, 81/177.8

(56) References Cited

U.S. PATENT DOCUMENTS

| | | | | |
|---|---|---|---|---|
| 1,568,442 | | 1/1926 | Carver . | |
| 1,615,169 | | 1/1927 | Ellis . | |
| 1,775,402 | | 9/1930 | Mandl . | |
| 2,627,330 | * | 4/1953 | Gantz | 81/177.2 |
| 2,978,938 | * | 4/1961 | Nalley | 81/177.8 |
| 3,376,768 | * | 4/1968 | Fortunato | 81/177.2 |
| 3,779,107 | | 12/1973 | Avery . | |
| 4,324,158 | | 4/1982 | LeRoy . | |
| 4,334,445 | * | 6/1982 | Timewell | 81/177.8 |
| 4,463,632 | | 8/1984 | Parke . | |
| 5,199,335 | * | 4/1993 | Arnold et al. | 81/177.8 |
| 5,694,818 | * | 12/1997 | Nickipuck | 81/60 |
| 5,996,448 | * | 12/1999 | Suekage | 81/177.2 |
| 6,000,299 | * | 12/1999 | Cole | 81/60 |

FOREIGN PATENT DOCUMENTS

| | | |
|---|---|---|
| 27238 | 4/1961 | (EP) . |
| 0377777 | 7/1990 | (EP) . |

OTHER PUBLICATIONS

Motor, Sep. 1996 p. 27.

* cited by examiner

*Primary Examiner*—James G. Smith
*Assistant Examiner*—Hadi Shakeri
(74) *Attorney, Agent, or Firm*—Paul M. Denks

(57) ABSTRACT

A locking device for a tool, such as a ratchet wrench, having a jointed drive head which may be situated in a series of angular positions relative to a handle, and which has means for temporarily holding the drive head of the tool at a predetermined angle with respect to the handle. The tool includes a spring-biased locking element disposed in the handle and which may be either engaged with, withdrawn from, or disengaged from the drive head. In the engaged position, the tool drive head is locked in place by the locking element. In the withdrawn position, the locking element is withdrawn from the head, and held away from it by the user to permit continuous changes in the angular relationship between the handle and the drive head. Finally, in the third orientation, the locking element is withdraw from the head and secured in a temporary holding position, allowing continual changes in the angular relationship between the handle and the head without the need for the user to continually hold the locking element.

6 Claims, 13 Drawing Sheets

102
504
116
126
122
500
502
506
144
508
104

102
110
116
146
126
504
122
500
502
506
144
508
104

102
126
122
510
504
512
104

102
126
122
510
512
512
104

LOCKING SWIVEL WRENCH

CROSS-REFERENCE TO RELATED APPLICATIONS

This application is a continuation application on application having Ser. No. 09/024,375, filed on Feb. 17, 1998 U.S. Pat. No. 6,167,787, which is a continuation application on application having Ser. No. 08/878,231, filed Jun. 18, 1997; U.S. Pat. No. 5,943,924 and which latter application is a continuation application of the application having Ser. No. 08/398,691, filed on Mar. 6, 1995, all of said applications still owned by the applicant herein abandoned.

STATEMENT REGARDING FEDERALLY SPONSORED RESEARCH OR DEVELOPMENT

Not Applicable.

BACKGROUND OF THE INVENTION

This invention relates generally to tools, and in particular to a locking device for tools such as ratchet wrenches having a handle portion and a head portion, the head portion being rotatably attached to the handle portion such that the head portion may be selectively positioned and locked in place in a plurality of angular relationships with respect to the handle portion.

Mechanics and other persons having reason to use ratchet wrenches frequently encounter situations where a nut to be removed or installed is either very difficult to reach, or, if accessible, is in such an awkward attitude or is obscured by an intervening structure in such a way that it is difficult to apply actuating torque. Solutions to these problems often involve the use of ratchet wrenches having head portions secured to the handle portion by means of a pivot hinge, allowing the head portion to be held at an angle relative to the handle portion. Many different locking means have been developed to secure the head in numerous selected angles relative to the handle portion of such ratchet wrenches. However, these locking means are often difficult to manipulate, making the tool awkward to use, particularly when held in one hand.

It is therefore, the principal object of this invention to provide, for a tool having a head portion adjustable at an angle relative to a handle portion, a locking mechanism which is both rugged and simple to manipulate.

BRIEF SUMMARY OF THE INVENTION

The primary object of this invention is to provide, for a tool having a head angularly adjustable relative to a handle portion a locking mechanism to secure the head in at a selected angular position.

A further object of this invention is to provide a locking mechanism which may be secured in a released position, allowing the angular position of the head relative to the handle portion to be smoothly and continually adjusted.

A further object of this invention is to provide a rugged locking mechanism which may be easily manipulated to either secure or release the head.

In accordance with the invention, generally stated, a ratchet wrench having a ratchet head and a drive handle is provided with at least one articulating joint which allows the ratchet head to be rotated approximately 180 degrees relative to the handle. A locking mechanism is provided to releasably lock the ratchet head in one of several angular positions relative to the drive handle. When in the locked position, the locking mechanism prevents rotation of the ratchet head, and will not be dislodged by application of pressure to the ratchet head, such as occurs during the application of torque. To release the locking mechanism, a locking element is withdrawn from engagement with the ratchet head, and either held away from the head during rotation, or rotated laterally into a locked-open position, allowing free rotation of the ratchet head.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description will clearly enable one skilled in the art to make and use the invention, describes several embodiments, adaptations, variations, alternatives, and uses of the invention, including what we presently believe is the best mode of carrying out the invention.

Figure 1:
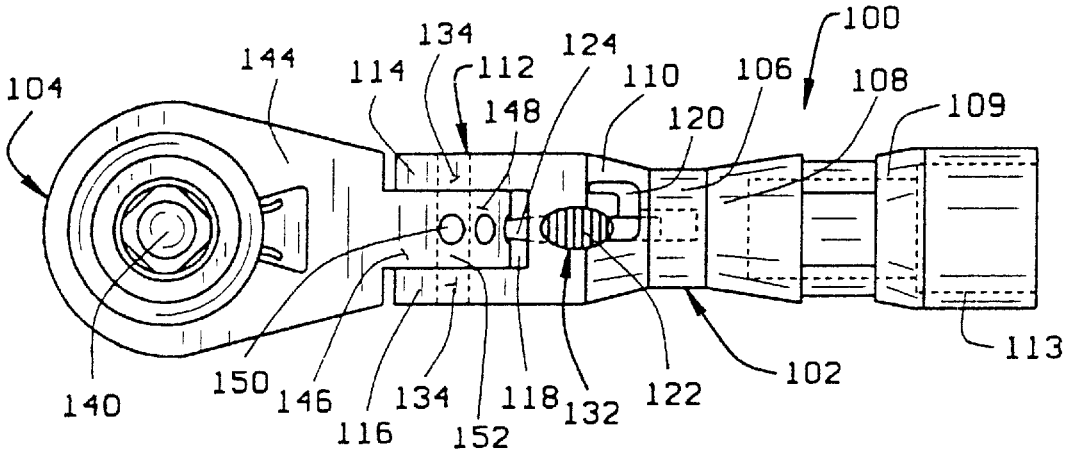
FIG. 1 is an elevational view of an adjustable head ratchet wrench with the preferred embodiment of the locking mechanism of the present invention engaging the adjustable head.
Figure 1A:
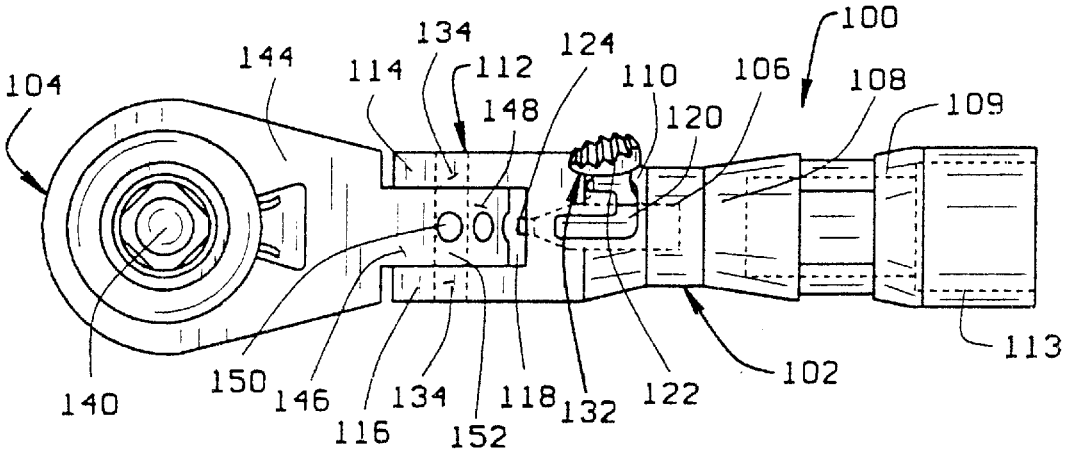
FIG. 1A is a an elevational view of the adjustable head ratchet wrench of FIG. 1 with the locking mechanism shown released from the adjustable head and laterally locked in a neutral position.
Figure 2:
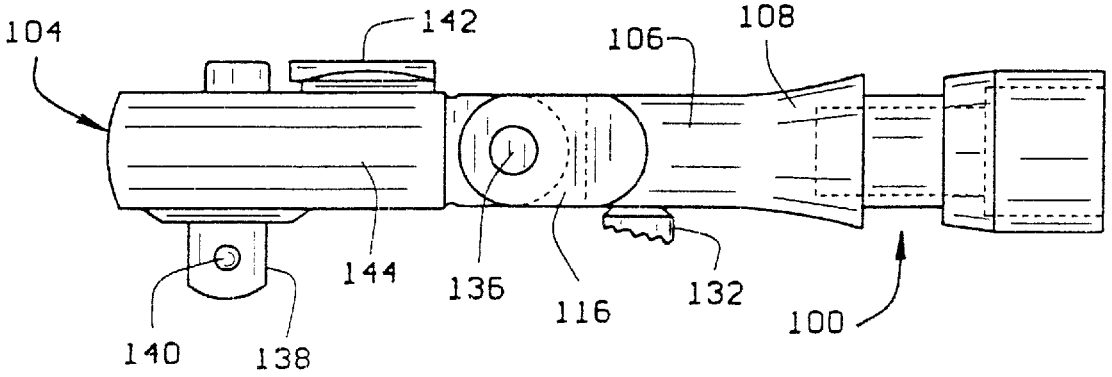
FIG. 2 is a side elevational view of the embodiment shown in FIG. 1.
Figure 3:
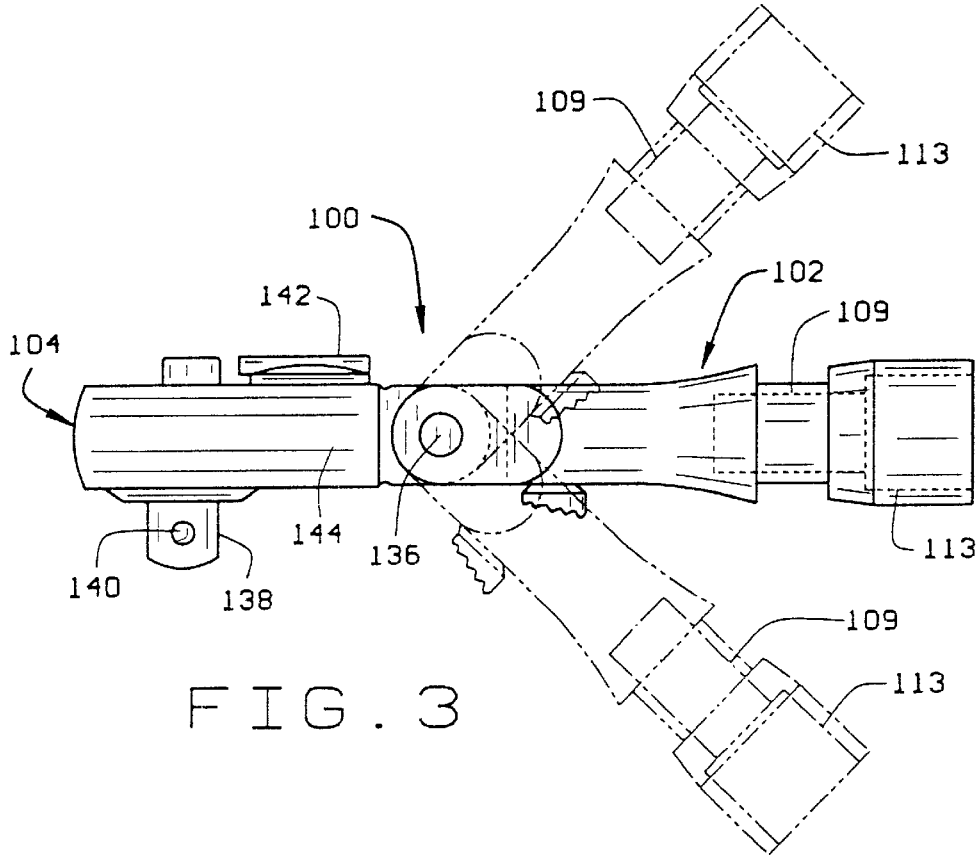
FIG. 3 is a side elevational view similar to FIG. 2, with the adjustable head shown in various selected angular positions relative to the ratchet wrench handle.
Figure 4:
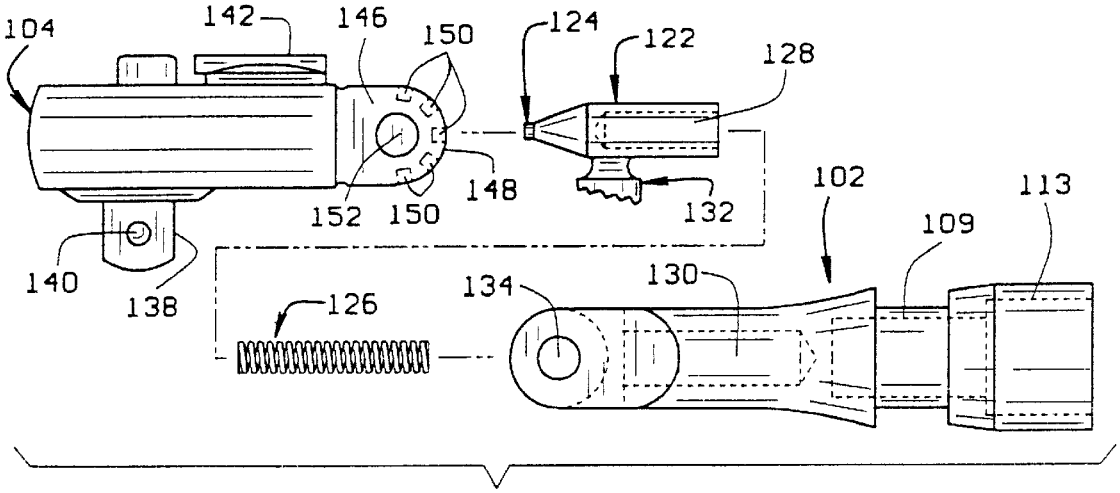
FIG. 4 is an exploded view of the embodiment shown in FIG. 2, illustrating the internal components of the locking mechanism.

FIGS. 1 to 7 illustrate the preferred embodiment of the swivel wrench lock of the present invention, indicated generally by reference numeral 100 in the drawings. Tool 100 has an adjustable drive handle 102 with an integral dual receptacle to fit any ⅜" socket extension 109 or ½" socket extension 113 to be used as a handle to apply torque, and an articulating drive head 104. The handle 102 has a body section 106 with a first flared end section 108 and a second flared end section 110 which is integrally attached to a U-shaped frame 112. The frame 112 has two opposed arms 114 and 116 which define a space 118. As best seen in FIG. 1A, communicating between the flared end 110 and the U-shaped frame 112, a hook-shaped slot 120 locks a spring biased pin actuator 122 in a neutral position to unlock the drive head 104 for easy adjustment. Shown in FIG. 6A, the actuator 122 has a locking pin 124 biased outwardly towards the space 118 by a bias spring 126 which seats in a bore 128 formed in the pin actuator 122. The bias spring 126 also seats in a bore 130 formed in the body section 106. The pin actuator 122 further includes a thumb pad 132 to provide a tactile engaging surface. As can be seen in FIGS. 2 through 4, the respective arms 114 and 116 have holes 134 formed adjacent to their respective ends to seat a pivot pin 136, securing the drive head 104 to the dual receptacle drive handle 102.

The drive head 104 includes a conventional ratcheting socket drive 138 with a detent ball 140. The ratcheting gearworks (not shown) in the drive head are controlled by a thumb lever 142. The drive head 104 tapers to a base 144, and a pivot arm 146 extends from the base. The pivot arm 146 has a rounded end 148 with a plurality of stop holes 150 formed in the radiused portion of the end 148. The stop holes 150 are dimensioned to allow the insertion of the locking pin 124 therein. A pivot hole 152 is formed through the pivot arm 146. The pivot arm 146 fits between arms 114 and 116, and is secured in place by the pivot pin 136 inserted through the pivot holes 134 and 152.

FIG. 3 best illustrates the articulating features of tool 100. The user can move the spring biased pin actuator 122 and retract the locking pin 124 from a stop hole 150, allowing the drive head 104 to then pivot freely about the pin 136 until it is in a desired angular position relative to the handle 102. The locking pin 124 and actuator 122 or 380 may be either held away from the stop hole 150 and drive head 104 manually or, once withdrawn, may be rotated laterally into the hook portion of the hook-shaped slot 120 or 366 as shown in FIGS. 1A, 12A and 12B. Releasing the spring-biased pin actuator in the hook portion of slot 120 will retain the locking pin 124 or 372 away from the stop hole 150 and drive head 104, allowing the drive head to continue to rotate freely.

Figure 5:
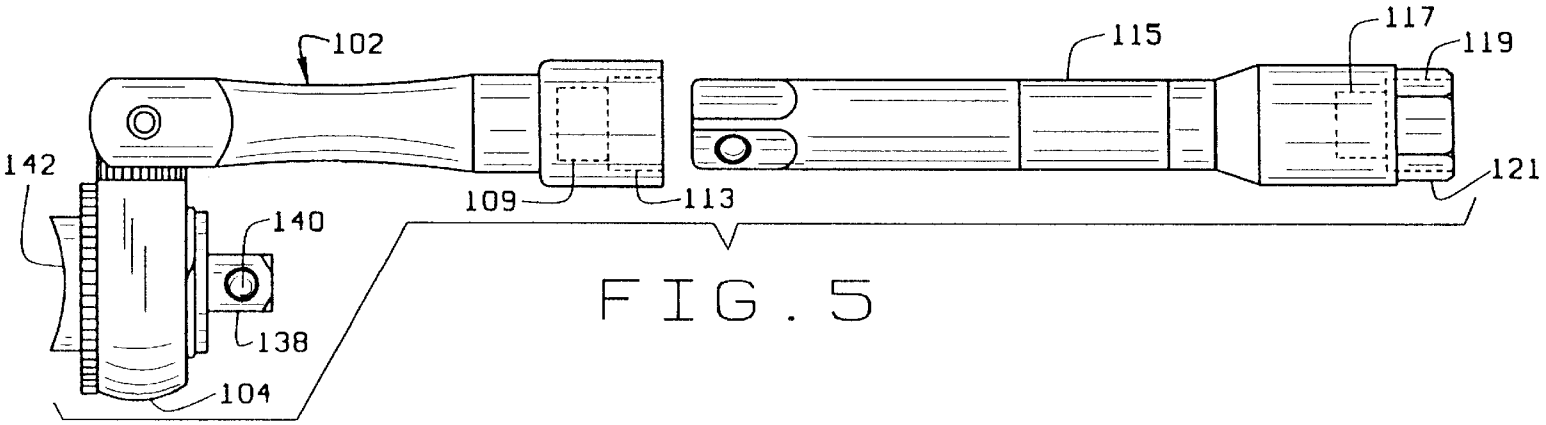
FIG. 5 is a side elevational view similar to FIG. 3, illustrating an extreme angular adjustment of the adjustable head relative to the handle portion, and a handle extender fitted to the handle.
Figure 6:
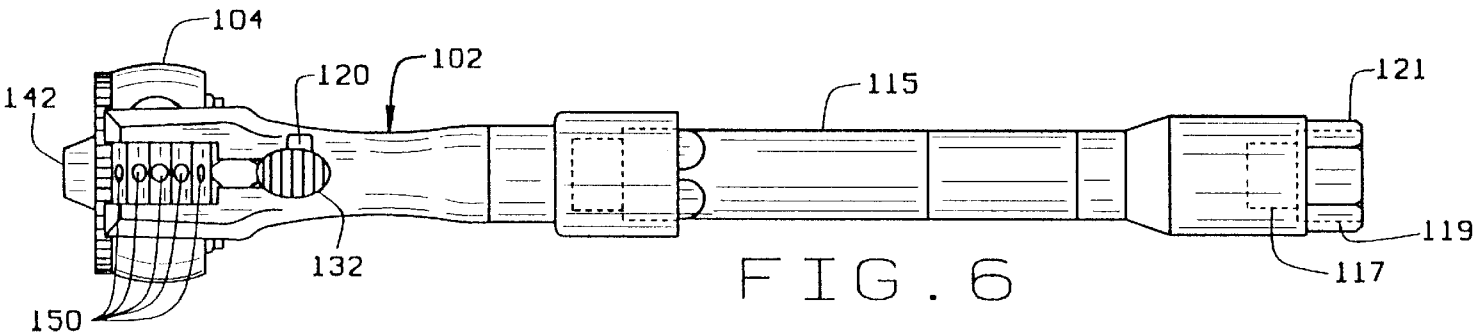
FIG. 6 is a top elevational view of the embodiment shown in FIG. 5.
Figure 7:
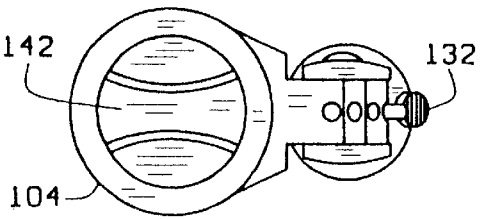
FIG. 7 is a front elevational view of the embodiment shown in FIG. 5.
Figure 6B:
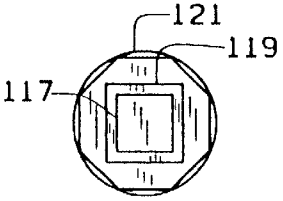
FIG. 6B is a top elevational view of a handle extender shown in FIG. 6A.

To lock the drive head 104 at a desired angular relation to the handle 102, the user rotates the pin actuator laterally out of the hook portion of slot 120 if necessary, and then releases the spring biased pin actuator 122 allowing the bias spring 126 to drive the locking pin 124 into a stop hole 150 aligned with the pin. When the locking pin 124 is driven into a stop hole 150, the drive head 104 of the tool is locked in position relative to the handle 104. As shown in FIGS. 4 through 7, the stop holes 150 are arranged around the radiused end 148 in such a manner that the drive head 104 can be articulated through approximately 180 degrees relative to the handle 102. Rotation of the drive head 104 relative to the handle 102 allows the tool 100 to apply torque in hard to reach places. FIGS. 5 and 6 depict a ½" socket extension 115 connected to the dual receptacle drive handle 113. The socket extension 115 has a integral dual receptacle to fit any ⅜" socket extension 117 or ½" socket extension 119 for adding additional socket extensions. The socket extension 115 has an external hex bolt 121 formed on one end for applying lateral torque with adjustable wrenches or socket wrenches (not shown).

Figure 8:
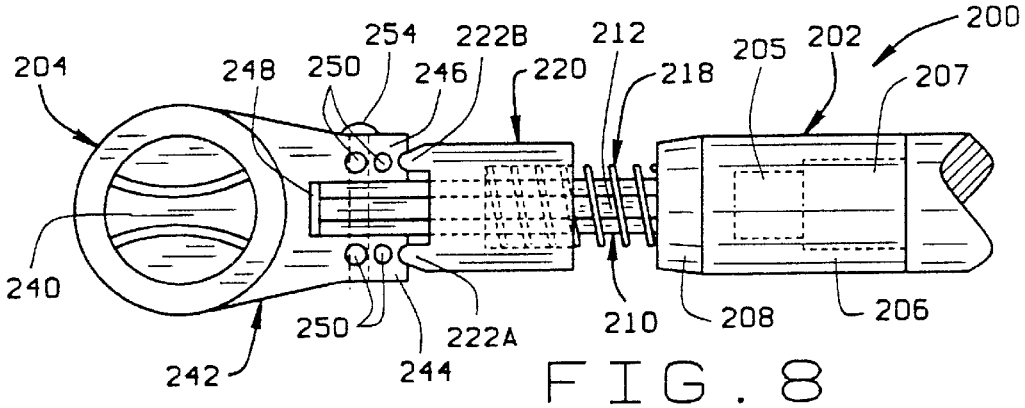
FIG. 8 is an illustration of an alternate embodiment locking mechanism of the present invention, including a spring loaded locking collar securing an adjustable head relative to a ratchet wrench handle.
Figure 9:
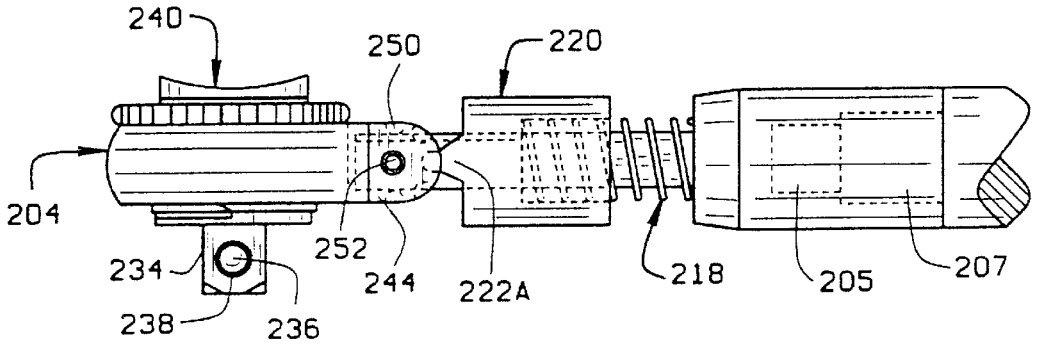
FIG. 9 is a side illustration of the embodiment shown in FIG. 8.
Figure 10:
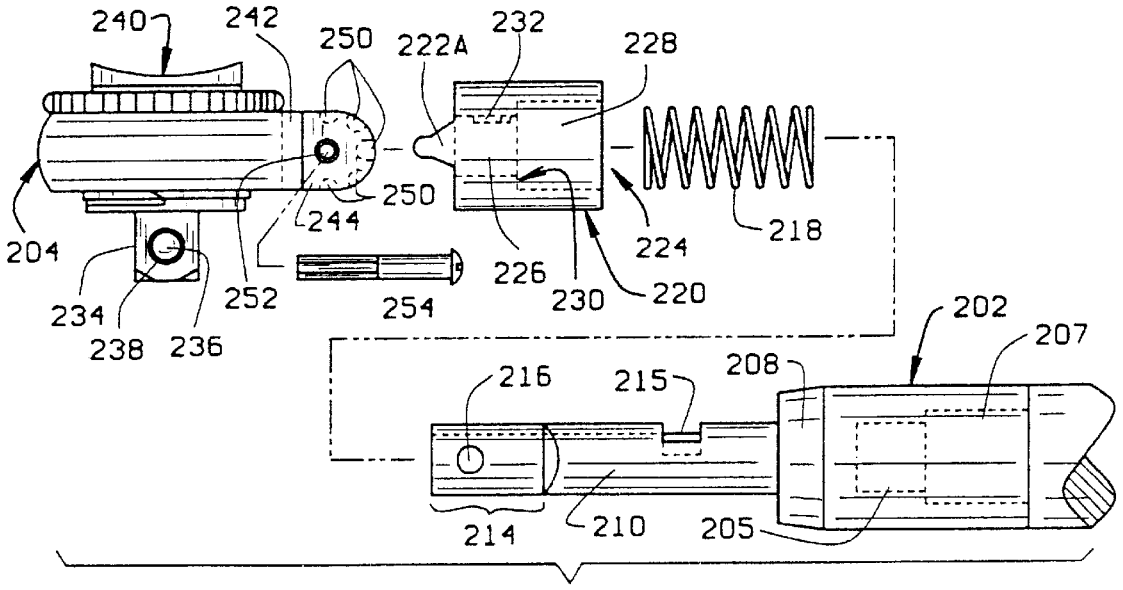
FIG. 10 is an exploded illustration of the alternate embodiment shown in FIG. 9, illustrating the internal components of the locking mechanism.

FIGS. 8 to 10 illustrate an alternate preferred embodiment of the swivel wrench lock of the present invention, indicated generally by reference numeral 200. Tool 200 has a handle 202 with an integral dual receptacle to fit and ⅜" socket extension 205 or ½" socket extension 207 to be used as a handle to apply torque, and an articulating drive head 204. The handle 202 includes a base section 206, with a tapered shoulder 208. An elongated rod 210 extends outwardly from the shoulder 208. The rod 210 has a locking groove 212 formed in the surface adjacent to the shoulder 208, and a flattened forward segment 214 with a pivot hole 216 formed therein. The locking groove 212 further includes a locking slot 215 adjacent the shoulder 208, extending perpendicular to the groove 212 around a thirty degree arc of the circumference of the rod 210. Surrounding the rod 210, a bias spring 218 is seated on the rod 210 and is retained thereon by a locking pin collar 220, seated on the forward segment of the rod.

The locking pin collar 220 is generally tubular in shape and has a pair of integral locking pins 222A and 222B extending outwardly from the sides of the collar on opposite sides of the forward segment 214. There is an axial bore 224 formed through the collar, having a first chamber 226 and a second chamber 228. The chambers are separated by an internal shoulder 230. A detent 232 protrudes into chamber 226, such that it is aligned within the locking groove 212 when the collar 220 surrounds the rod 210. Accordingly, the chamber 228 is dimensioned to allow the bias spring 218 to seat therein and abut the shoulder 230, and the chamber 226 is dimensioned to allow the insertion of the flattened forward segment 214 of the rod 210 therethrough.

Drive head 204 includes a conventional ratcheting drive 234 with a spring biased detent ball 236 in a cavity 238. A conventional thumb control 240 operates the ratcheting gearworks (not shown) inside the head 204. The drive head incorporates an integral neck 242 having a pair of opposed tabs 244 and 246, defining a space 248. The outer ends of the respective tabs are radiused, and have a plurality of locking holes 250 formed therein. The locking holes 250 are dimensioned to allow the insertion of the engaging pins 222A and 222B therein. Each tab includes a pivot hole 252 formed transversely therein, positioned such that when the flattened forward segment 214 of the rod 210 seats in the space 248, a pivot pin 254 may be inserted through the holes 252 in the tabs, as well as the hole 216 in the rod to pivotally secure the drive head to the handle.

In use, the bias spring 218 urges the locking pin collar 220 towards the drive head 204, engaging pins 222A and 222B into the locking holes 250, to lock the drive head in an angular position relative to the handle 202. The collar 220 may be drawn back against the bias spring 218, withdrawing the engaging pins out of the locking holes and allowing the drive head 204 to pivot about the pivot pin 254 until a desired angular relationship with the handle 202 is reached. The locking pin collar 220 can be retained in a withdrawn position by pulling it back until the detent 232 is aligned with the lock slot 215, and then rotating the locking pin collar laterally to engage the detent in the locking slot 215. The bias force of the bias spring 218 will retain the locking pin collar 220 in the locking slot 215 until released by lateral rotation. The release of the locking pin collar 220, and the bias spring 218, either from the locking slot 215 or the withdrawn position will drive the locking pins 222A and 222B into the locking holes 250, locking the drive head in the desired angular position. The holes are positioned along the tabs 244 and 246 such that the drive head 204 can be rotated through an arc of approximately 180 degrees relative to the handle. Rotation of the drive head 204 relative to the handle 202 allows the tool 200 to apply torque in hard to reach places.

Figure 11:
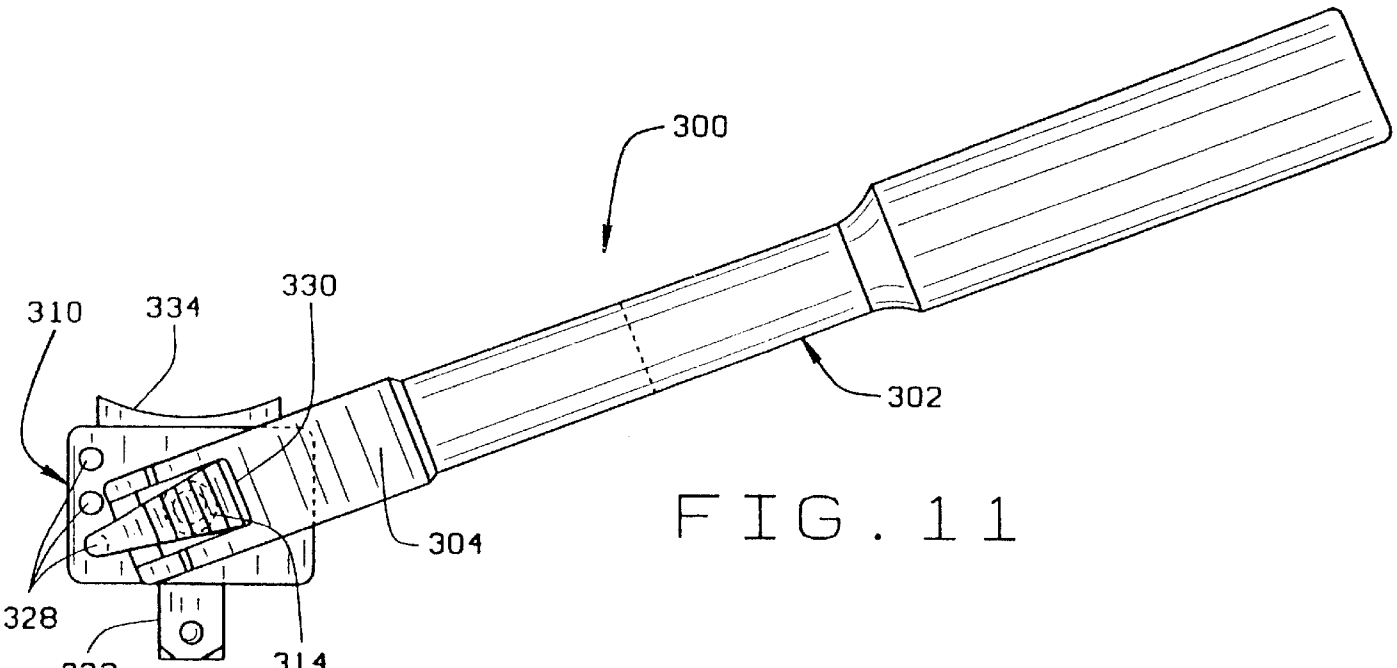
FIG. 11 is a side elevational view of an alternate embodiment locking mechanism of the present invention, illustrating separate and independent locking elements.
Figure 12:
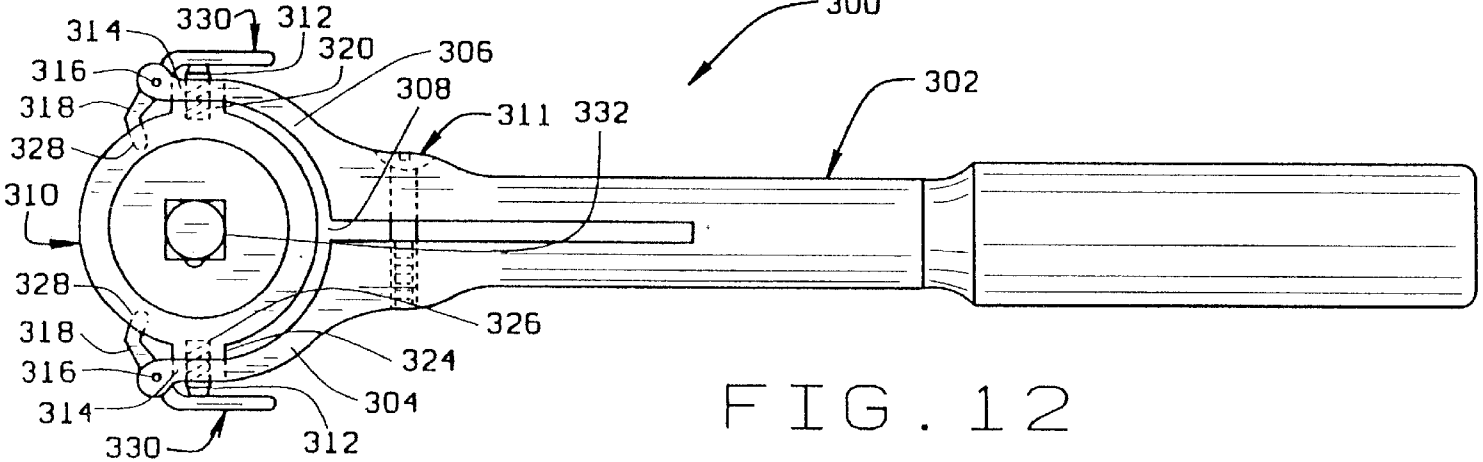
FIG. 12 is a top elevational view of the embodiment shown in FIG. 11.
Figure 12A:
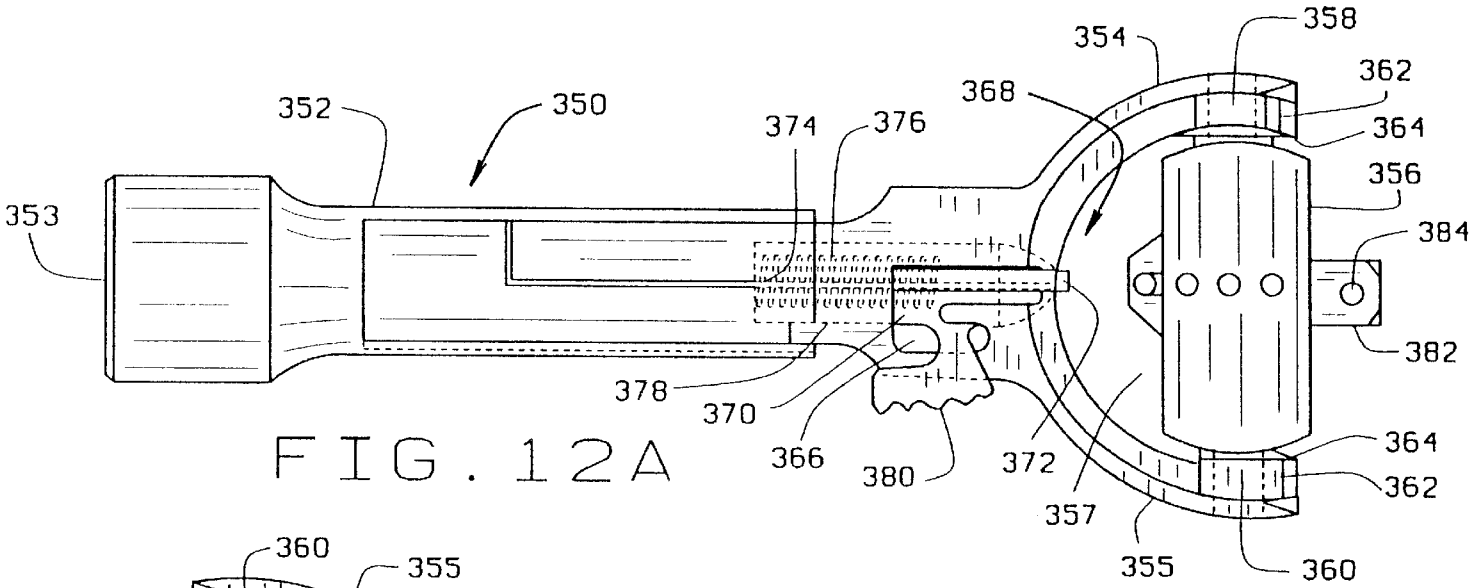
FIG. 12A is an illustration of an alternate embodiment locking mechanism of the present invention, incorporating an axial locking pin shown released from the adjustable head and laterally locked in place, and securing the adjustable head via side pivot points.
Figure 12B:
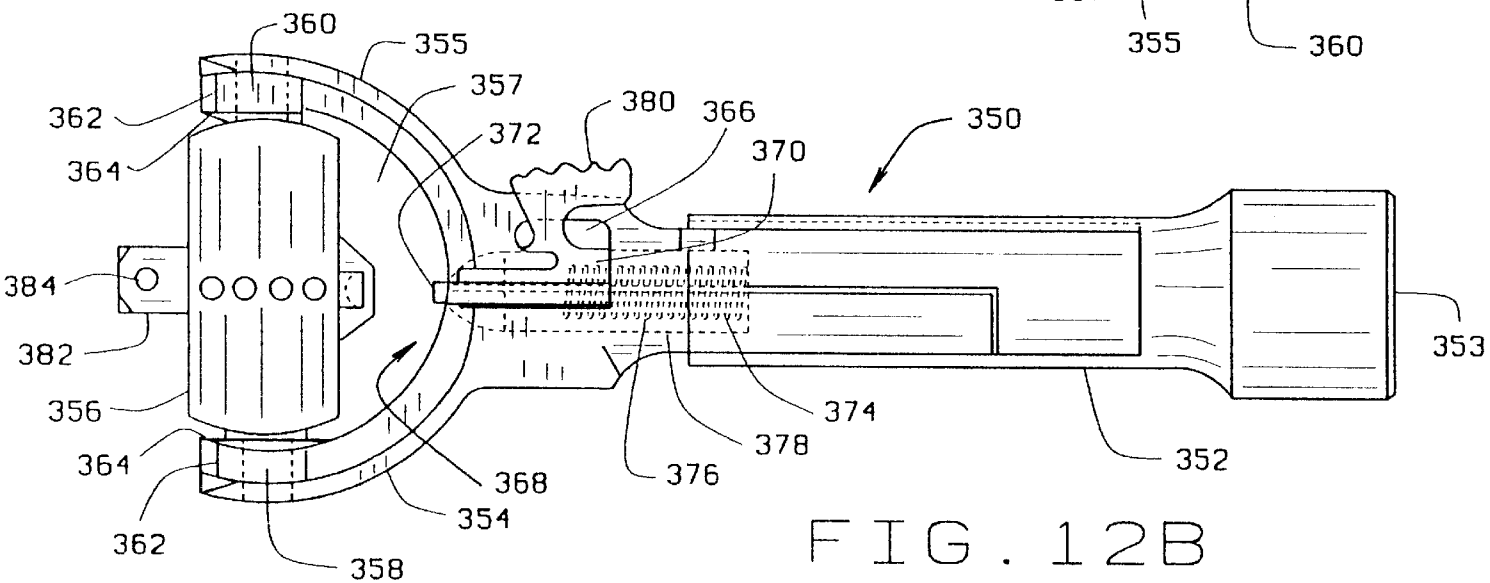
FIG. 12B is an illustration of the alternate embodiment shown in FIG. 12A as viewed from a different angle.
Figure 12C:
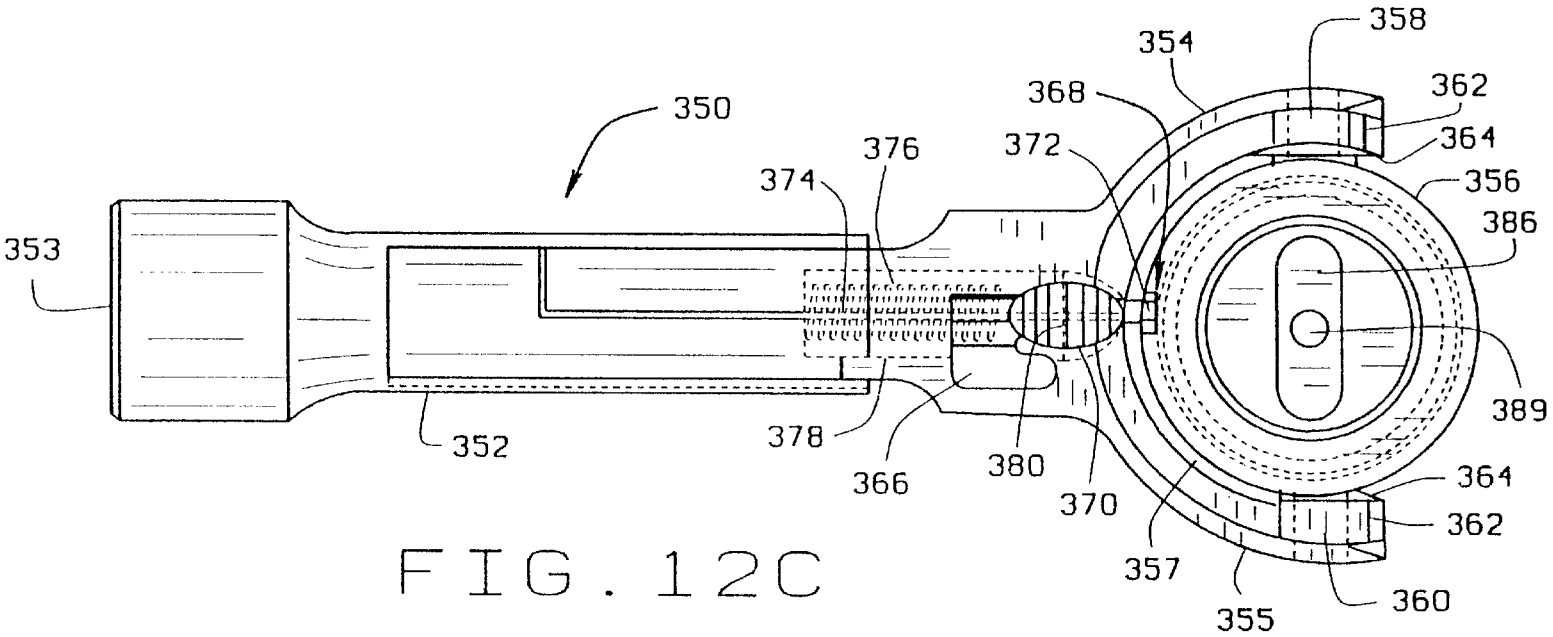
FIG. 12C is an illustration of the embodiment shown in FIG. 12A, with the adjustable head locked parallel to the handle.

FIGS. 11 and 12 illustrate another preferred embodiment of the locking swivel wrench lock of the present invention, indicated generally by reference number 300. Tool 300 has a drive handle 302, terminating in a pair of opposed arms 304 and 306 on the first or upper end of the handle. The arms define a space 308 wherein a drive head 310 is supported, and are prevented from movement by a threaded support pin 311. Each arm 304 and 306 includes a bias spring 312 seated in a bore 314 adjacent to the upper end of the respective arm. The upper ends of each arm 304 and 306 include identical pivots 316, each supporting a thumb actuated pivotal locking pin 318 rotatably attached to the pivot 316 such that rotation of the locking pins 318 engages and disengages the drive head 310.

The drive head 310 is seated in space 308 with clearance to rotate through a full 360 degree arc. The drive head 310 includes a first boss 320 with a spring seating bore 322 formed therein, and a second boss 324 with a second spring seating bore 326 formed therein, integrally formed on the opposite sides and aligned with the bores 314 on the arms 304 and 306. Pivot pins (not shown) are seated inside each spring 312, and extend through bores 322 and 326 respectively, to seat in each bore 314, pivotally holding the drive head 310 within space 308. The drive head 310 further includes a number of locking holes 328 arranged in an arcuate pattern, forward of bosses 320 and 324.

In a normally spring-biased position, each locking pin 318 is driven into one of the locking holes 328, securing the drive head 310 against any rotation about the pivot pins (not shown). Each locking pin 318 can be actuated by exerting pressure against a lever portion 330, causing the locking pin to pivot about point 316, and withdraw from the locking hole 328. Thus withdrawn, the drive head 310 can be moved in angularly relative to the drive handle 302. The drive head 310 further includes a conventional ratchet drive 332, thumbwheel actuator, 334 and ratcheting gearworks (not shown).

FIGS. 12A through 12C and FIGS. 27–28 illustrate another preferred embodiment of the swivel wrench lock of the present invention based upon a similar drive handle structure as the embodiment shown in FIGS. 11 and 12. Shown generally at 350, the tool includes a drive handle 352, with an integral receptacle (not shown) to fit any length ½" socket extension to be used as a handle to apply torque, terminating at one end in two opposing arms 354 and 355, which define a space 357. A drive head 356 is supported in the space 357, between the arms 354 and 355 by means of pivot pins 358 and 360, extending laterally from the drive head and seating within an identical bore 362 in each arm 354 and 355. A washer 364 is fitted around each pivot pin, between the drive head 356 and each arm, ensuring the drive head is free to rotate about an axis defined by the pivot pins 358 and 360, with reduced frictional interference.

Figure 27:
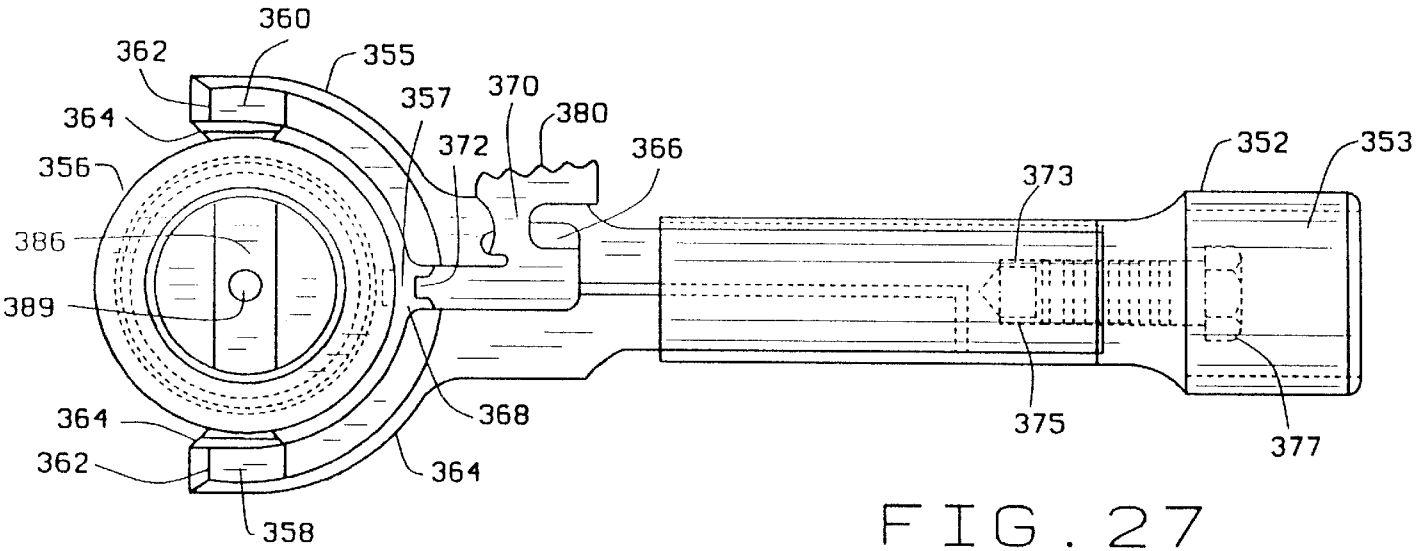
FIG. 27 is an illustration of an alternate embodiment of the locking swivel wrench of the present invention illustrated in FIG. 12, detailing internal structures of the handle.
Figure 28:
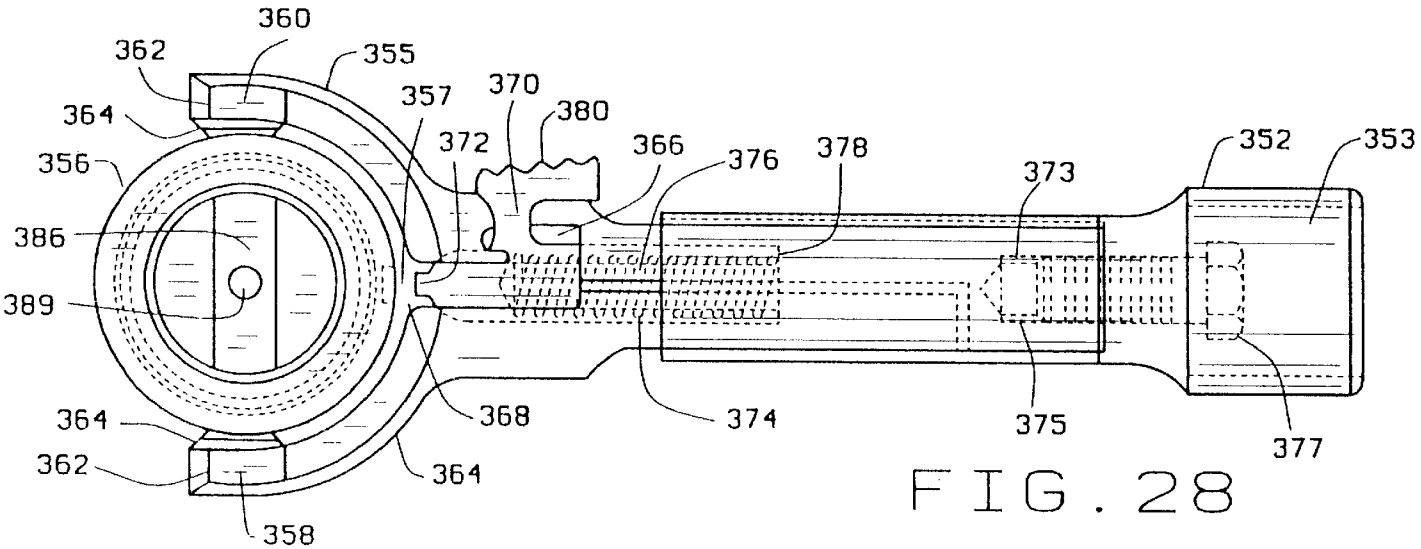
FIG. 28 is an illustration of an alternate embodiment of the locking swivel wrench of the present invention illustrated in FIG. 12, detailing internal structures of the locking mechanism.

The drive handle 352 further includes a longitudinal hook-shaped slot 366, terminating at the base 368 of the arms 354 and 355 which engages a spring biased pin actuator 370. Shaped identical to the actuator shown in FIG. 6A, the actuator 370 has a locking pin 372 biased outwardly towards the space 357 by a bias spring 374 which seats in a bore 376 formed axially in the pin actuator 370. FIG. 27 illustrates the locking pin 372 without the bias spring 374 for clarity. The bias spring 374 also seats in an axial bore 378 formed in the arm 354 and arm 355 at the base of the slot 366. The pin actuator 370 further includes a thumb pad 380 to provide a tactile engaging surface. A threaded bore 373 shown in FIGS. 27 and 28 at the end of arm 355 and a threaded bore 375 at the end of arm 354 are held in place by drive handle 352 and secured by a bolt 377.

The drive head 356 includes a conventional ratcheting socket drive 382 with a detent ball 384. The ratcheting gearworks (not shown) in the drive head are controlled by a thumb lever 386. The drive head 356 is formed as an oblate spheroid, with a plurality of stop holes 388 arrayed on the radiused portions, aligned with the locking pin 372. An additional stop hole 389 is placed at the axial center of the thumb lever 386. Each stop hole 388 is dimensioned to allow the insertion of the locking pin 372 therein.

Use of the tool 350 is substantially similar to that described above for the embodiment shown in FIGS. 1 through 7, with the added benefit that the drive head 356 is capable of rotating through a full 360 degrees relative to the drive handle 352. The additional stop hole 389 placed on the thumb lever 386 allows the drive head to be secured in axial alignment with the drive handle, allowing the tool 300 to function as an extension ratchet.

Figure 14:
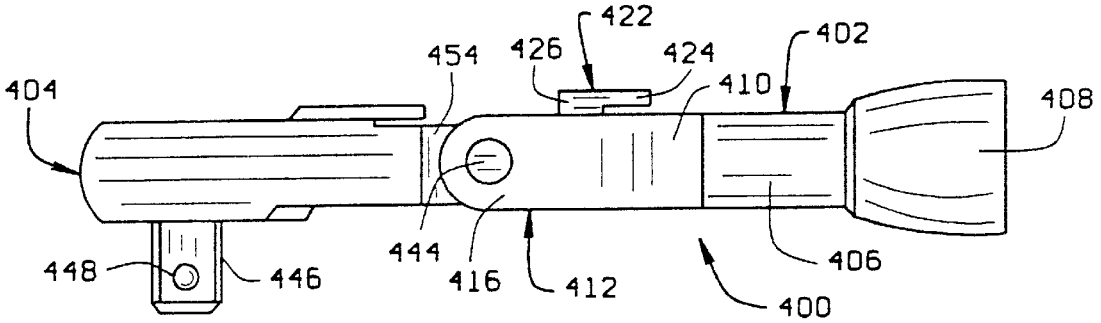
FIG. 14 is a side elevational view of the embodiment shown in FIG. 13.
Figure 15:
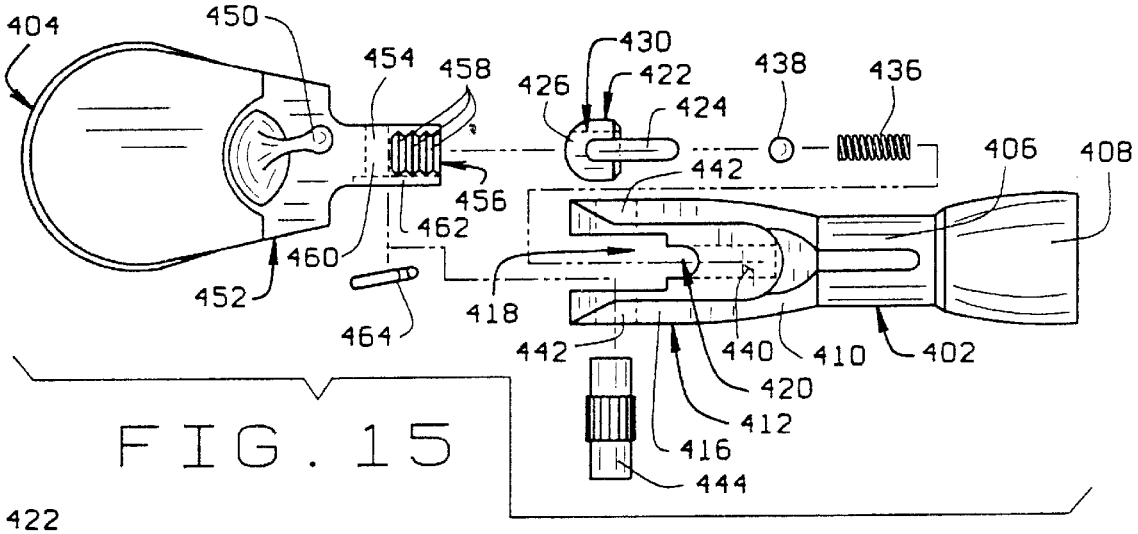
FIG. 15 is an exploded view of the embodiment shown in FIG. 13, illustrating the internal components of the locking mechanism.
Figure 16A:
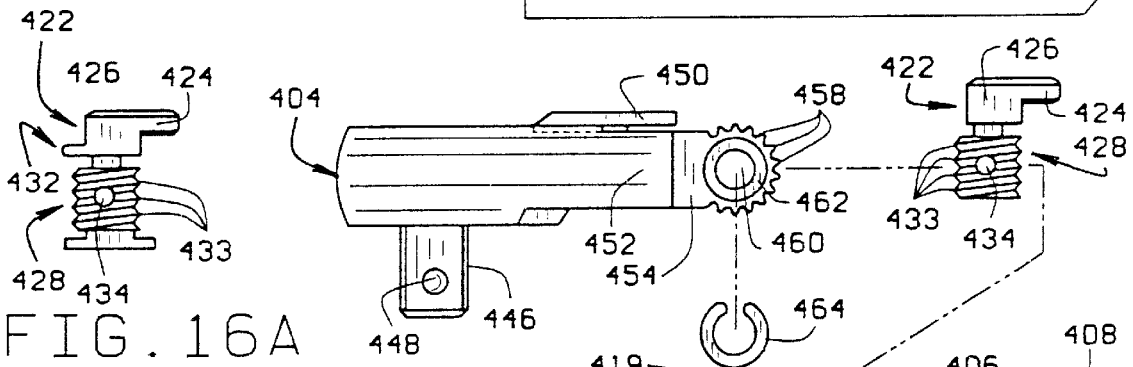
FIG. 16A is a side elevational view of one embodiment of the transversely mounted locking element.
Figures 16, 16B:
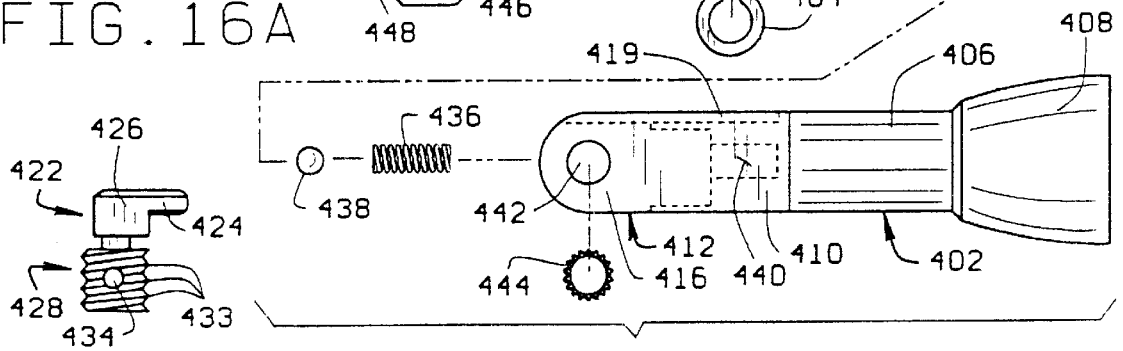
FIG. 16 is side view of the components shown in FIG. 15.
FIG. 16B is a side elevational view of a second embodiment of the transversely mounted locking element.

FIGS. 13 through 16 illustrate another preferred embodiment of the swivel wrench lock of the present invention, indicated generally at 400. Tool 400 has an adjustable drive handle 402 and an articulating drive head 404. The handle 402 has a body section 406 with a first flared end section 408 with an integral dual receptacle (not shown) to fit any ⅜" or ½" socket extension to be used as a handle to apply torque. A second flared end section 410 is integrally attached to a U-shaped frame 412. The frame 412 has two opposed arms 414 and 416 which define a space 418. As best seen in FIG. 16, communicating between the flared end 410 and the U-shaped frame 412, is a recessed portion 419 in the upper surface of section 410. A transverse slot 420 at one end of the recessed portion 419 receives a thumb lock 422.

Figure 13:
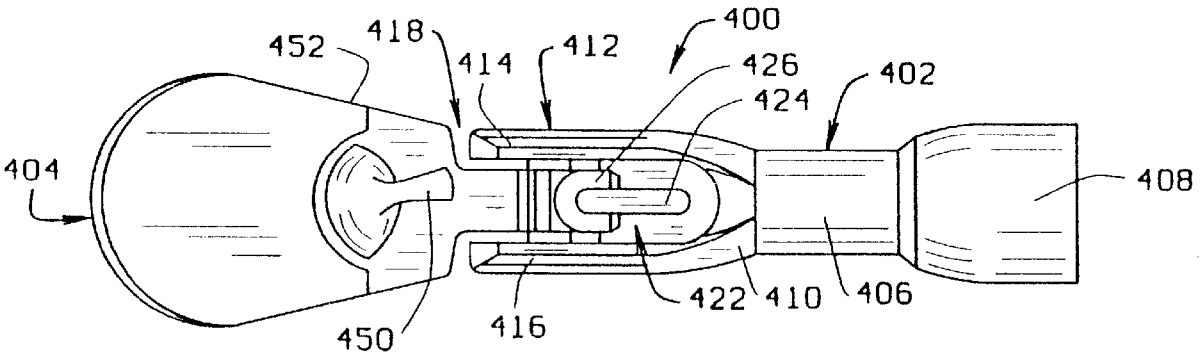
FIG. 13 is a top elevational view of an alternate embodiment of the locking mechanism of the present invention, including a transversely mounted locking element intermeshing with the base of the adjustable head.

The thumb lock 422, best seen in FIG. 16A, includes a lever arm 424 on an upper surface 426, a cylindrical body 428 with a flattened surface 430 extending downward from the upper surface, and a retaining flange 432 arrayed parallel to the upper surface. The cylindrical body 428 of the thumb lock 422 is received in the transverse slot 420, with the upper surface 426 and lever arm 424 resting on the recessed portion 419 as seen in FIG. 13. The radiused portion of the cylindrical body 428 includes a number of circumferential teeth 433, and a retaining detent 434. A bias spring 436 and detent ball 438 are fitted within an axial bore 440 in section 410, such that rotation of the thumb lock 422 engages and disengages the detent ball 438 in the retaining detent 434.

As can be seen in FIGS. 14 through 16, the respective arms 414 and 416 have holes 442 formed adjacent their respective ends to seat a pivot pin 444, securing the drive head 404 to the handle 402. The drive head 404 includes a conventional ratcheting socket drive 446 with a detent ball 448. The ratcheting gearworks (not shown) in the drive head are controlled by a thumb lever 450. The drive head 404 tapers to a base 452, and a pivot arm 454 extends from the base. The pivot arm 454 has a rounded end 456 with a plurality of parallel locking grooves 458 formed in the radiused portion with a slightly larger diameter than the pivot arm 454. The locking grooves 458 are dimensioned to mesh with the circumferential teeth 433 of the thumb lock 422, and traverse more than 180° to provide a true 90° locking handle in either direction relative to the drive head. A pivot hole 460 is formed through the pivot arm 454, with one side including a recessed seat 462 for a tension ring 464. The pivot arm 454 fits between arms 414 and 416, and is secured in place by the pivot pin 444 inserted through the pivot holes 442 and 460, and tension 464.

During use, the user can move the thumb lock 422 and engage or disengage the circumferential teeth 433 from the locking grooves 458, allowing the drive head 404 to then pivot about the pin 444 until it is in a desired angular position relative to the handle 402. When the teeth 433 are disengaged from the locking grooves 458, the flattened surface 430 is aligned with the locking grooves, allowing the drive head 404 to rotate freely. Additionally, the bias spring 436 drives the detent ball 438 into the retaining detent 434, holding the thumb lock in the released position until a rotation force sufficient to overcome the spring bias is exerted. To lock the drive head 404 at a desired angular relation to the handle 402, the user rotates thumb lock 422 out of the release position, engaging the teeth 433 with the locking grooves 458. When the teeth and grooves engage, the drive head 404 of the tool is locked in an angular position relative to the handle 404. As shown in FIGS. 15 and 16, the locking grooves are arranged around the radiused end 456 in such a manner that the drive head 404 can be articulated through approximately 180 degrees relative to the handle 402. Rotation of the drive head 404 relative to the handle 402 allows the tool 400 to apply torque in hard to reach places.

Figure 6A:
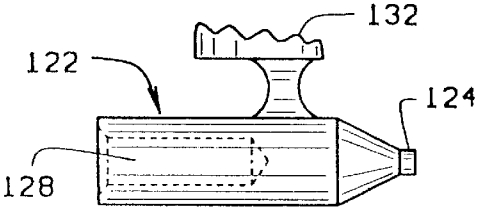
FIG. 6A is a side elevational view of a locking pin component of the preferred locking mechanism.
Figures 17, 18, 19, 20:
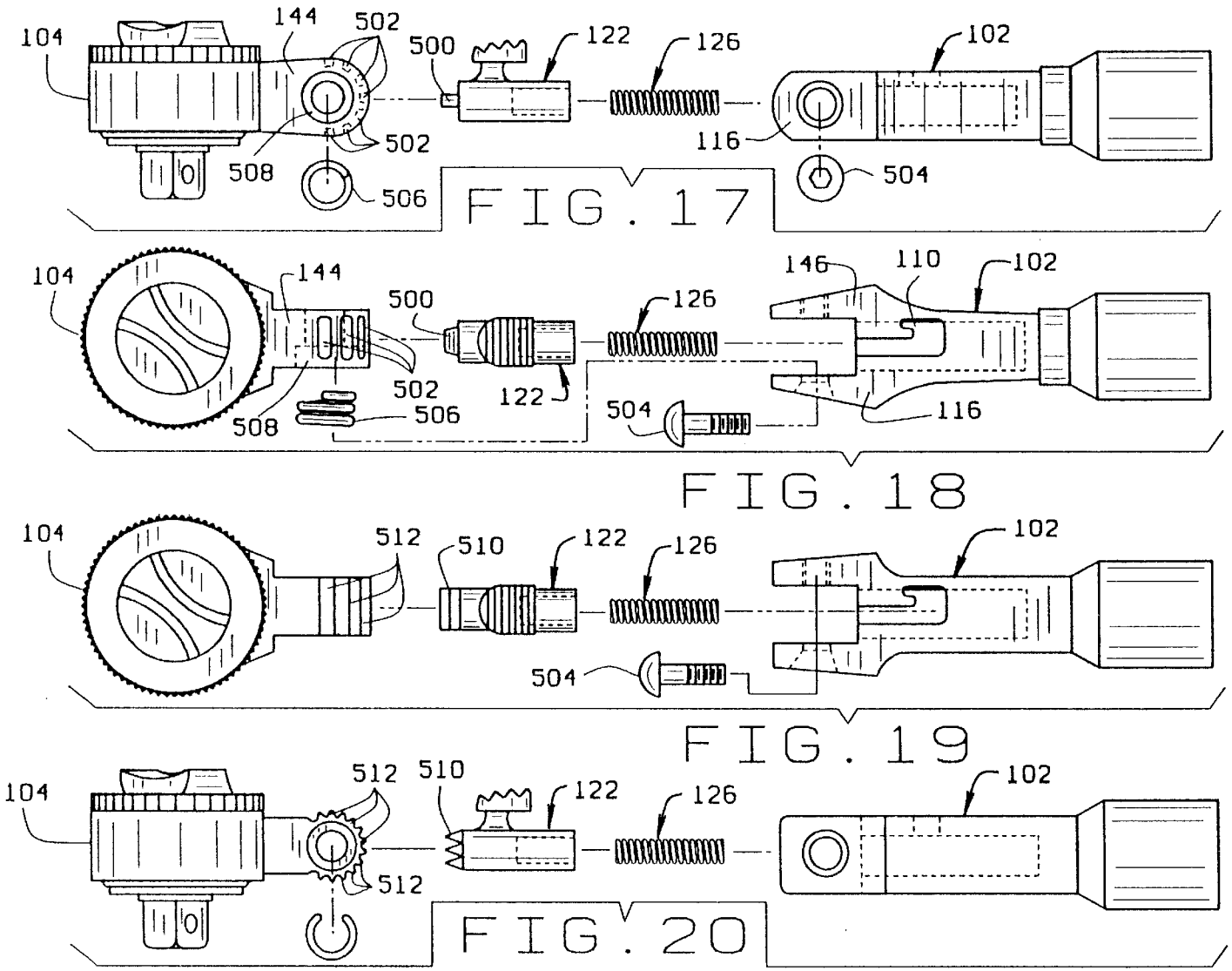
FIG. 17 is an exploded side elevation of an alternate embodiment of an adjustable head ratchet wrench incorporating a tongue and groove locking mechanism of the present invention
FIG. 18 is an exploded top elevation of the embodiment shown in FIG. 17.
FIG. 19 is an exploded top elevation of an alternate embodiment of an adjustable head ratchet wrench incorporating a toothed locking mechanism of the present invention.
FIG. 20 is an exploded side elevation of the embodiment shown in FIG. 19.

FIGS. 17 through 20 illustrate alternate embodiments of the locking swivel wrench of the present invention illustrated in FIGS. 1 through 7. Turning to FIGS. 17 and 18, the locking pin 124 of actuator 122 in FIG. 6A is replaced with a locking tongue 500, and the stop holes 150 are replaced with matching stop grooves 502. Additionally, the pivot pin 136 in FIG. 2 is replaced with a combination of a threaded hinge pin 504 and a compression spring 506 seated in a recess 508 between the drive head base 144 and the arm 116 of the frame 112. FIGS. 19 and 20 are identical to FIGS. 17 and 18, however, the locking tongue 500 and matching stop grooves 502 are replaced with locking teeth 510 and matching stop radial recesses 512, allowing multiple teeth and recesses to mesh when locking the drive head 104 in position and traversing more than 180° to provide a true 90° locking handle in either direction relative to the drive head.

Figure 21:
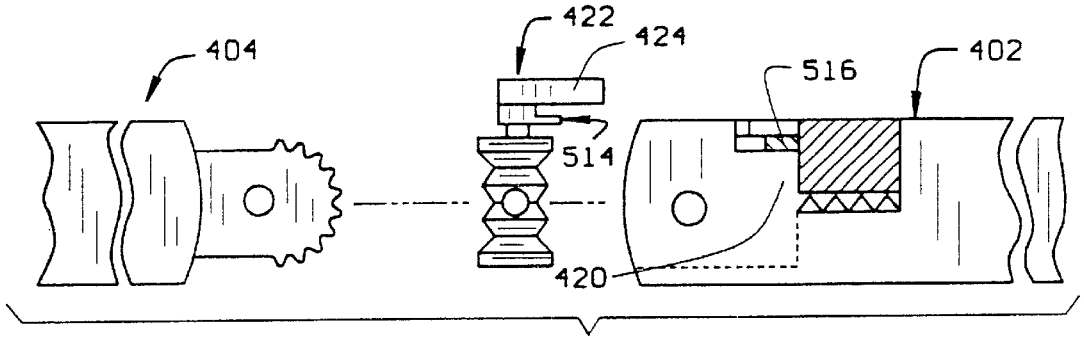
FIG. 21 is an exploded side elevation similar to FIG. 16, illustrating an alternate configuration for the transversely mounted locking element.
Figure 22:
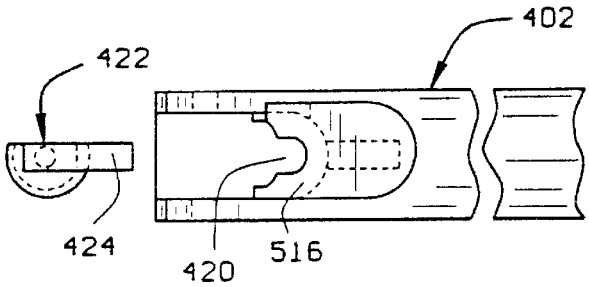
FIG. 22 is a partial exploded top elevation similar to FIG. 15, incorporating the alternate configuration of FIG. 21.
Figure 23:
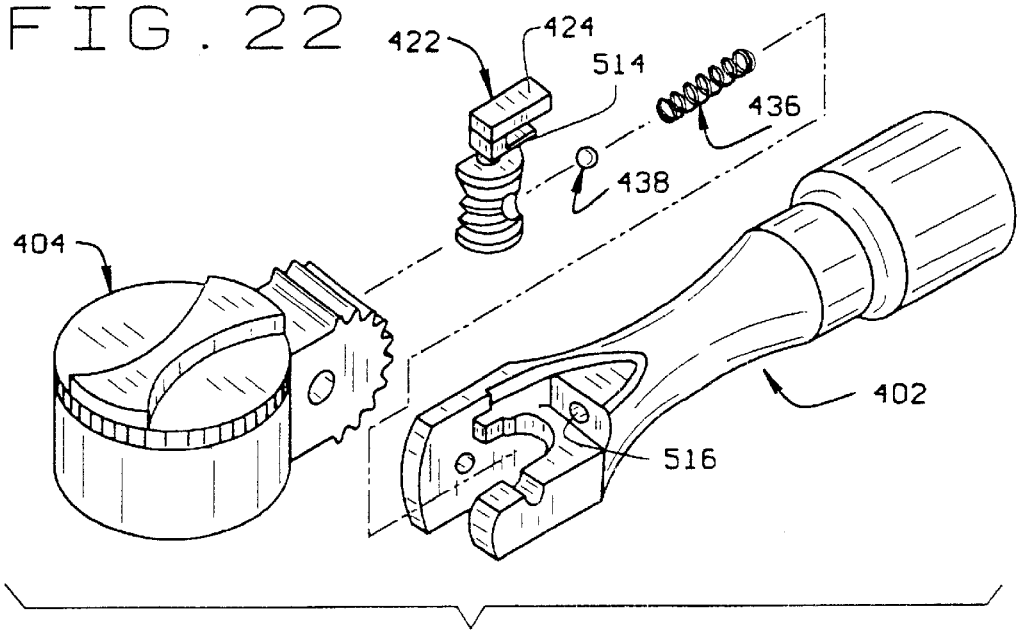
FIG. 23 is an exploded and cut-away perspective view of the alternate embodiment shown in FIG. 21.

FIGS. 21 through 23 illustrate an alternate embodiment of the swivel wrench lock of the present invention illustrated in FIGS. 13 through 16. The thumb lock 422 includes an additional retaining flange 514, located directly below, and parallel to, the lever arm 424. A corresponding recessed slot 516 is located adjacent the transverse slot 420, and receives the retaining flange 514 when the thumb lock 422 is inserted therein. The retaining flange 514 aids in stabilizing the thumb lock 422 during rotation.

Figure 24:
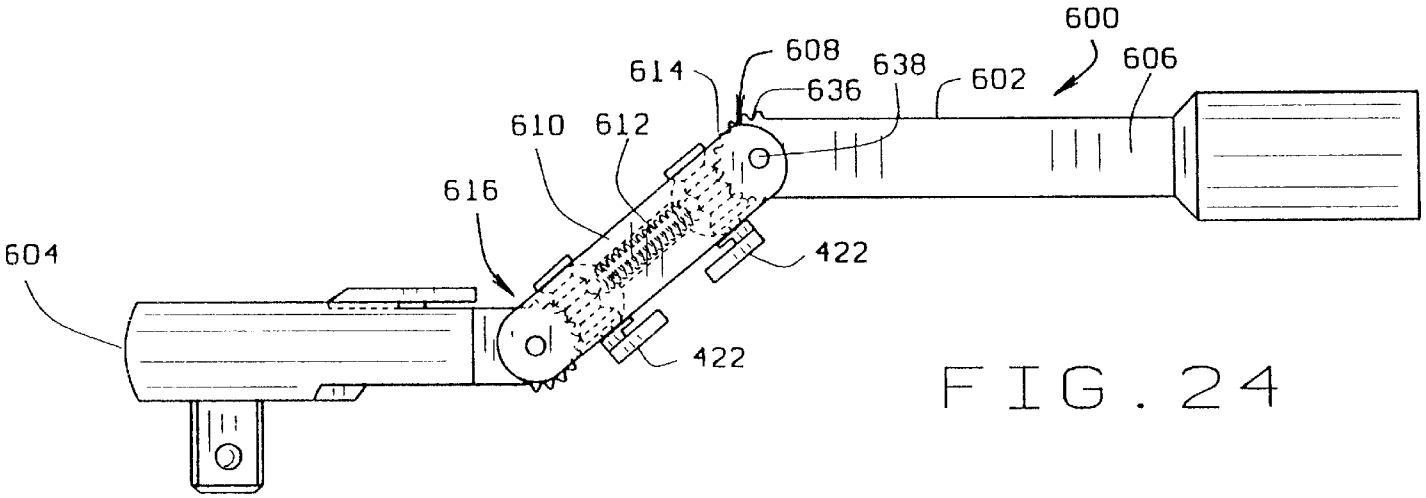
FIG. 24 is an illustration of a alternate embodiment of a ratchet wrench employing dual locking elements of the present invention to provide a greater variety of angular positions within which the adjustable head may be positioned relative to the handle.
Figure 25:
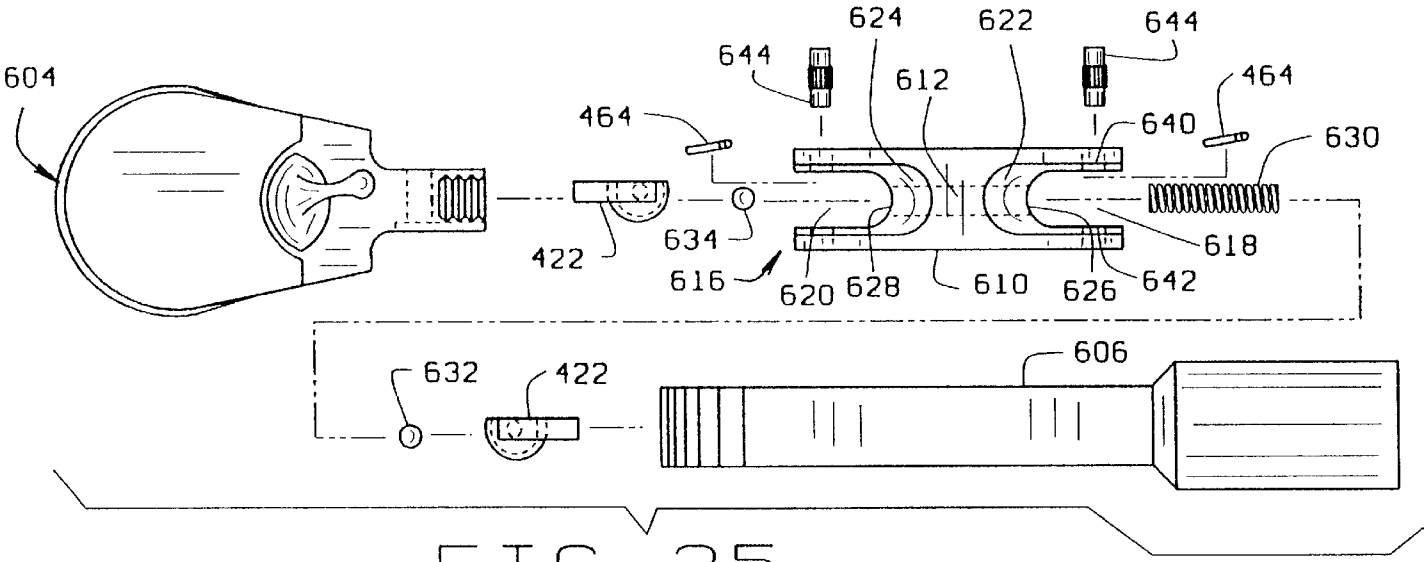
FIG. 25 is an exploded top illustration of the embodiment shown in FIG. 24, illustrating the internal components of the dual locking mechanisms of the present invention.

FIGS. 24 and 25 illustrate an alternate embodiment of the locking dual swivel wrench of the present invention, indicated generally at 600. Tool 600 includes a multi-sectioned handle 602 and an articulating drive head 604. The handle 602 includes a body section 606 with a radiused end 608, and an intermediate connector 610. The connector 610 has an axial bore 612, and terminates at opposite ends in U-shaped frames 614 and 616, each identical to frame 412 shown in FIG. 13. The bore 612 extends through connector 610, and opens into spaces 618 and 620, defined by frames 614 and 616 recessed portions 622 and 624 in the upper surface of the connector. A transverse slot 626 and 628 at the end of each respective recessed portion receives a thumb lock 422, the construction and operation of which is described above in connection with FIGS. 13–16 and 21–23. Bias spring 630, seated in bore 612 replaces bias spring 436. The length of bias spring 630 is sufficient that detent ball 632 and 634, placed at opposite ends of the spring are sufficiently biased to retain the respective thumb locks 422 in the disengaged positions as described above.

The drive head 604 of this embodiment is constructed identically to drive head 404. Correspondingly, drive handle 602 includes a number of parallel locking grooves 636 on the radiused end 608 to interlock with the thumb lock 422 located in recess 624. The drive handle 602 is pivotally linked to connector 610 by means of a pivot pin 638 inserted through bores 640 and 642 in the arms of frame 614, and through bore 644 in the end 608.

During use, either thumb lock 422 may be either engaged or disengaged with the corresponding locking grooves in drive handle 602 or the drive head 604, allowing for double-jointed articulation. Double-jointed articulation allows the tool 600 to be employed in locations where a single-jointed tool would be incapable of exerting torque.

Figure 26:
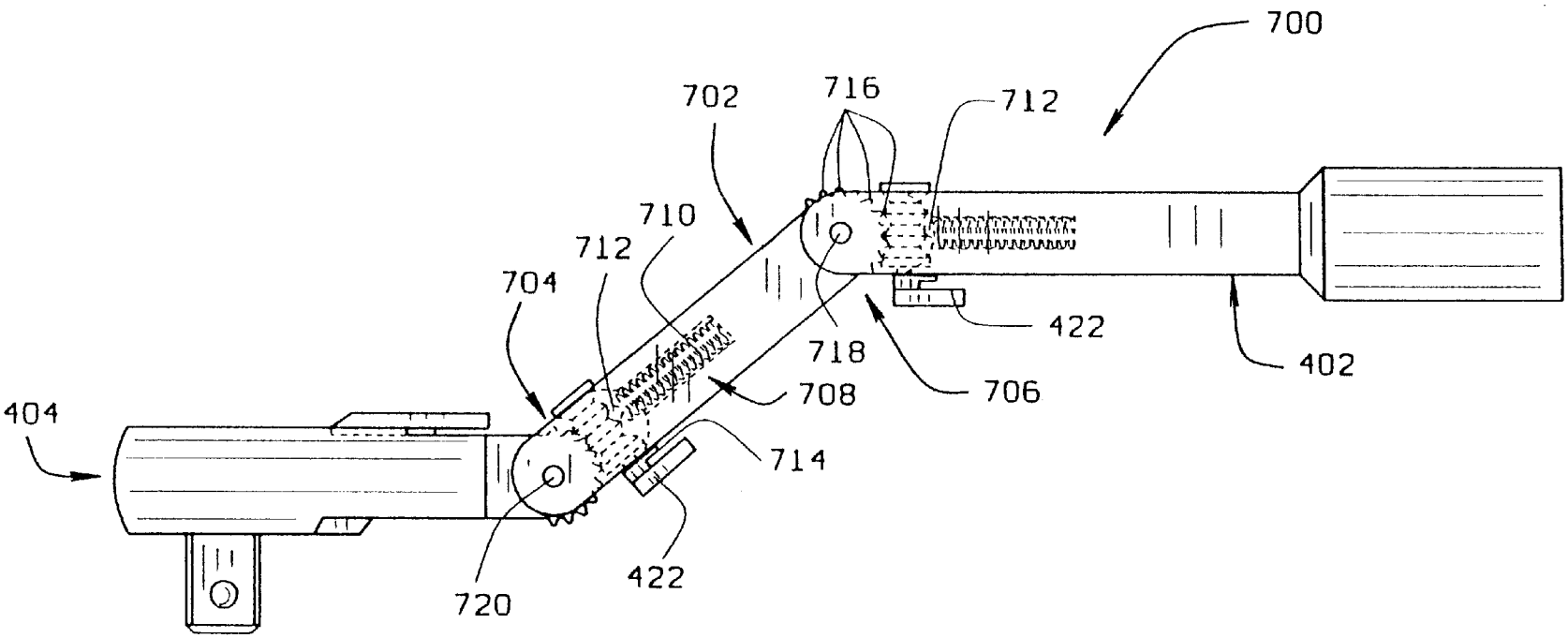
FIG. 26 is an illustration of an alternate embodiment of the double-jointed locking swivel wrench of the present invention illustrated in FIGS. 24 and 25.

FIG. 26 illustrates an alternate embodiment of the double-jointed dual locking swivel wrench lock of the present invention illustrated in FIGS. 24 and 25. Indicated generally at 700, the tool incorporates the drive handle 402, drive head 404, and thumb lock 422 of FIG. 13 with an intermediate connector 702 including a single U-shaped frame 704 and a radiused end 706. The frame 704 is constructed identical to frame 412, and 704 and a radiused end 706. The frame 704 is constructed identical to frame 412, and incorporates the structures needed to support a thumb lock 422, including a bore 708, bias spring 710, detent ball 712, and recessed portion 714. The radiused end 706 has locking grooves 716, constructed identical to the locking grooves 458 on drive head 404.

The drive handle 402 is pivotally connected to the radiused end 706 by means of a pivot pin 718, and the drive head 404 is similarly connected to the frame 704 by means of a second pivot pin 720. This allows for double-jointed articulation of the drive hand and the drive head relative to each other, allowing the tool 700 to be employed in locations where a singlejointed tool would be incapable of exerting torque.

One skilled in the art will further recognized that additional numbers of joints may be employed in the locking dual swivel wrench, and that a variety of locking mechanisms including each of those described above may be incorporated to engage and disengage the drive head from the drive handle, allowing angular adjustments to be made.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. A multi-functional adjustable hand tool providing double-jointed dual locking swivel means comprising:

a drive handle;

a drive head pivotally attached to said drive handle, pivotal at least 180 degrees relative to said handle;

said drive head including an integral pivot arm for pivotal attachment to said drive handle, said pivotal arm having uniform thickness and a radiused portion opposite said drive head;

said drive handle including a connector, said connector having opposite ends, said connector being pivotally attached to the radiused portion of said drive head, and said handle being pivotally attached to the opposite end of said connector;

a locking means provided, at each end of the connector, and each locking means having an engaged position for locking the drive head in a desired position relative to said drive handle, and a disengaged position for releasing each locking means from the drive head and the handle, whereby double-jointed dual locking of the swivel means secures the drive head in an angular position relative to the drive handle; and a retaining means for temporarily retaining said locking means in a disengaged position, for retaining said locking means located apart from the drive head and the handle, said retaining means including a transverse slot provided at said opposite ends of said connector into which said locking means may locate for fixedly retaining said locking means disengaged form said drive head and the handle, to thereby allow said drive head to pivot relative to the drive handle during application.

2. The hand tool of claim 1, wherein the locking means engage the drive handle to the drive head through the connector at various angular positions.

3. The adjustable hand tool of claim 2 wherein the radiused portion of the pivot arm for the drive head having a plurality of receiving elements, said receiving elements having an outer diameter approximating the uniform thickness of the pivot arm, said receiving elements provided for reception of the locking means for engaging the drive head and handle at a fixed angular relationship.

4. The adjustable hand tool of claim 2 wherein said drive handle having an integral pivot arm extending forwardly thereof, said pivot arm having a uniform thickness and a radiused portion, a plurality of receiving elements provided upon the radiused portion of the pivot arm of the drive handle, said receiving elements having an outer diameter approximating the uniform thickness of the pivot arm, and said locking means provided for engaging said receiving elements of the pivot arm for the drive handle for retaining said drive handle and connector at a relative angular position during usage of the hand tool.

5. The adjustable hand tool of claim 1, wherein said drive head accommodates a ratchet for application as a multi-functional adjustable hand tool during usage.

6. The adjustable hand tool of claim 1, wherein said drive handle, and the drive head, may be adjusted to undertake dual angular settings relative to each other through their respective pivot arms, when engaged to said connector.

* * * * *